US006535844B1

(12) United States Patent
Wood et al.

(10) Patent No.: US 6,535,844 B1
(45) Date of Patent: Mar. 18, 2003

(54) METHOD OF DETECTING SILENCE IN A PACKETIZED VOICE STREAM

(75) Inventors: Robert Geoffrey Wood, Ottawa (CA); Franck Beaucoup, Ottawa (CA)

(73) Assignee: Mitel Corporation, Ontario (CA)

( * ) Notice: Subject to any disclaimer, the term of this patent is extended or adjusted under 35 U.S.C. 154(b) by 196 days.

(21) Appl. No.: 09/580,788

(22) Filed: May 30, 2000

(30) Foreign Application Priority Data

May 28, 1999 (GB) ..... 9912577

(51) Int. Cl.[7] ..... G10L 11/00
(52) U.S. Cl. ..... 704/210; 704/215; 704/226
(58) Field of Search ..... 764/210, 213, 764/215, 219, 226, 208, 220, 222, 223

(56) References Cited

U.S. PATENT DOCUMENTS 4,449,190 A * 5/1984 Flanagan et al. ..... 364/513.5
4,982,341 A 1/1991 Laurent ..... 364/517
5,351,338 A * 9/1994 Wigren ..... 704/219
5,659,622 A * 8/1997 Ashley ..... 381/94
5,706,392 A * 1/1998 Goldberg et al. ..... 704/210
5,794,199 A * 8/1998 Rao et al. ..... 704/258
5,812,737 A * 9/1998 Wang ..... 704/207
5,890,109 A * 3/1999 Walker et al. ..... 704/215
5,978,756 A * 11/1999 Walker et al. ..... 704/210
5,978,760 A * 11/1999 Rao et al. ..... 704/226
6,311,154 B1 * 10/2001 Gersho et al. ..... 704/219

FOREIGN PATENT DOCUMENTS

EP 0238075 9/1987
GB 2048616 12/1980

OTHER PUBLICATIONS

Search Report of Great Britain Application No. 9912577.5.

* cited by examiner

*Primary Examiner*—Susan McFadden
(74) *Attorney, Agent, or Firm*—F.Chau&Associates,LLP

(57) ABSTRACT

A method and apparatus for detecting silence in voice packets. A packet energy calculator calculates a smoothed energy value for each packet of voice data to be transmitted. A noise level detector adaptively calculates noise values during periods of said silence. A silent packet detector compares the energy value to the noise value and if it is less than the noise value and less than a predetermined silence ceiling value then silence is indicated. Also, if the energy value is less than a predetermined silence noise value then silence is also indicated.

10 Claims, 3 Drawing Sheets

METHOD OF DETECTING SILENCE IN A PACKETIZED VOICE STREAM

FIELD OF THE INVENTION

This invention relates in general to packetized voice communication systems, and more particularly to a method of detecting silence in a stream of voice packets that is robust to low-energy fricatives at the end of speech bursts. The method requires very little computation and can easily be implemented in hardware.

BACKGROUND OF THE INVENTION

A packetized voice transmission system comprises a transmitter and a receiver. The transmitter collects voice samples and groups them into packets for transmission across a network to the receiver. The transmitter performs no operations upon the data. The data itself is companded according to u-law or A-law, as defined in ITU-T specification G.711, and is transmitted continuously at a constant TDM data rate (Time Division Multiplexing).

In order to save network bandwidth, packets of samples are only transmitted if voice activity is detected in the packet (i.e. voice data is not transmitted if the packet contains silence). It is known in the art for transmitters to test each packet for silence, prior to transmission, and after a sequence of packets is detected as containing silence, inhibiting transmission of subsequent silence packets until the next "non-silent" packet is detected.

In the event of silence detection, it is known to generate comfort noise to the listening party, as set forth in commonly-assigned UK Patent Application No. 9927595.0 filed Nov. 22, 1999.

One example of a prior art system utilises complex digital signal processing (DSP) to detect voice, rather than silence, as set forth in U.S. Pat. No. 5,276,765 and pendix A of ITU-T specification G.728.1.

Another approach is based on determining the energy level of a signal and comparing it with a silence threshold energy level. This approach is less effective than the previously mentioned DSP approach but is considerably less expensive to implement in hardware. Examples of this latter approach are set forth in U.S. Pat. Nos. 4,028,496; 4,167,653; 4,277,645; 5,737,695 and 5,867,574.

SUMMARY OF THE INVENTION

According to the present invention, a system is provided for detecting silence in a voice packet by comparing the voice energy with an adaptive silence threshold which allows for varying levels of background noise in the transmitter. In response to detecting silence, the transmitter is halted in order to preserve channel bandwidth. Inhibition of the transmitter is delayed after detecting silence so as not to clip the beginning or ending of talk spurts and so as to pass fricatives.

BRIEF DESCRIPTION OF THE DRAWINGS

A detailed description of a preferred embodiment of the present invention is provided herein below with reference to the following drawings in which.

DETAILED DESCRIPTION OF THE PREFERRED EMBODIMENT

Figure 1:
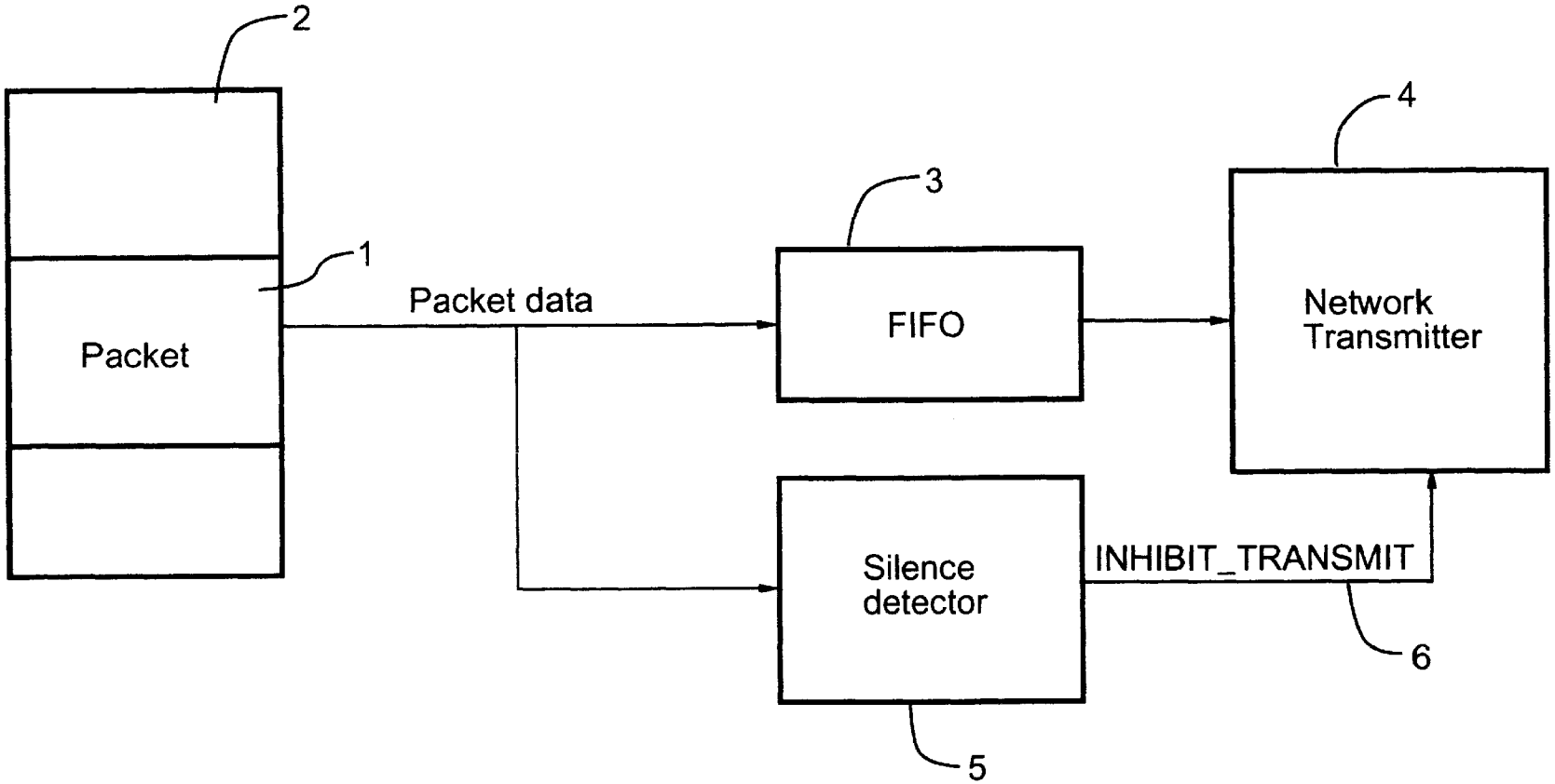
FIG. 1 is a block diagram showing a transmitter with silence detector according to the present invention.

With reference to FIG. 1, a packet of voice data samples (1) is formed in a buffer memory (2). When the required number of samples has been collected, the packet is read out of the buffer and passed to a FIFO (3) for transmission over the network by a network transmitter (4). A silence detector (5) detects the presence of silence in a packet and in response inhibits transmission of the packet over the network by applying a INHIBIT_TRANSMIT signal (6) to a control input of the network transmitter 4.

Figure 3:
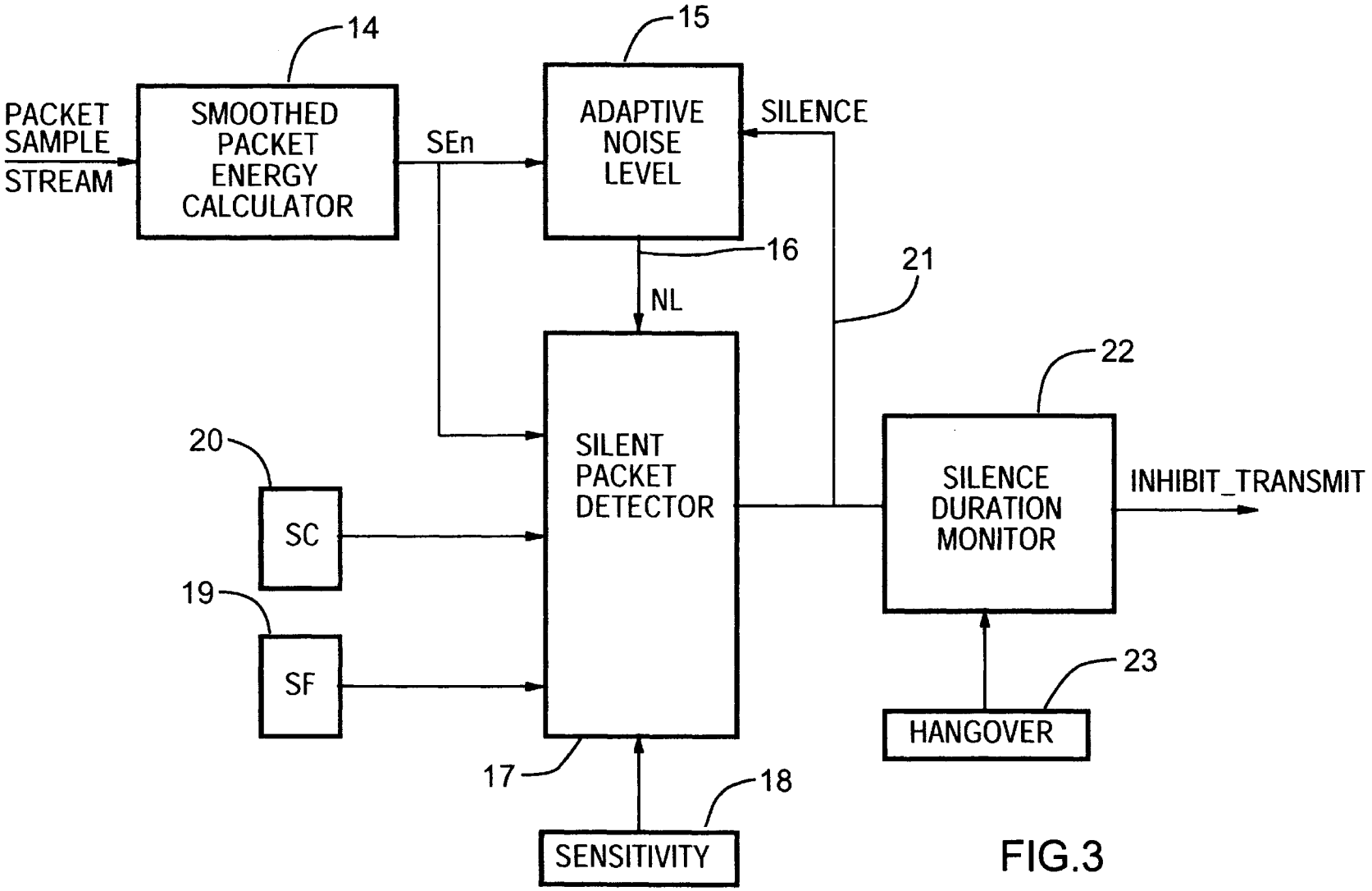
FIG. 3 is a block diagram of the silence detector according to the preferred embodiment of the invention.

The silence detector (5) comprises several components, as shown generally in FIG. 3. The packet data enters the silence detector as a stream of packet samples which are fed to a block (14) that calculates an average, or smoothed energy, for the stream.

Figure 2:
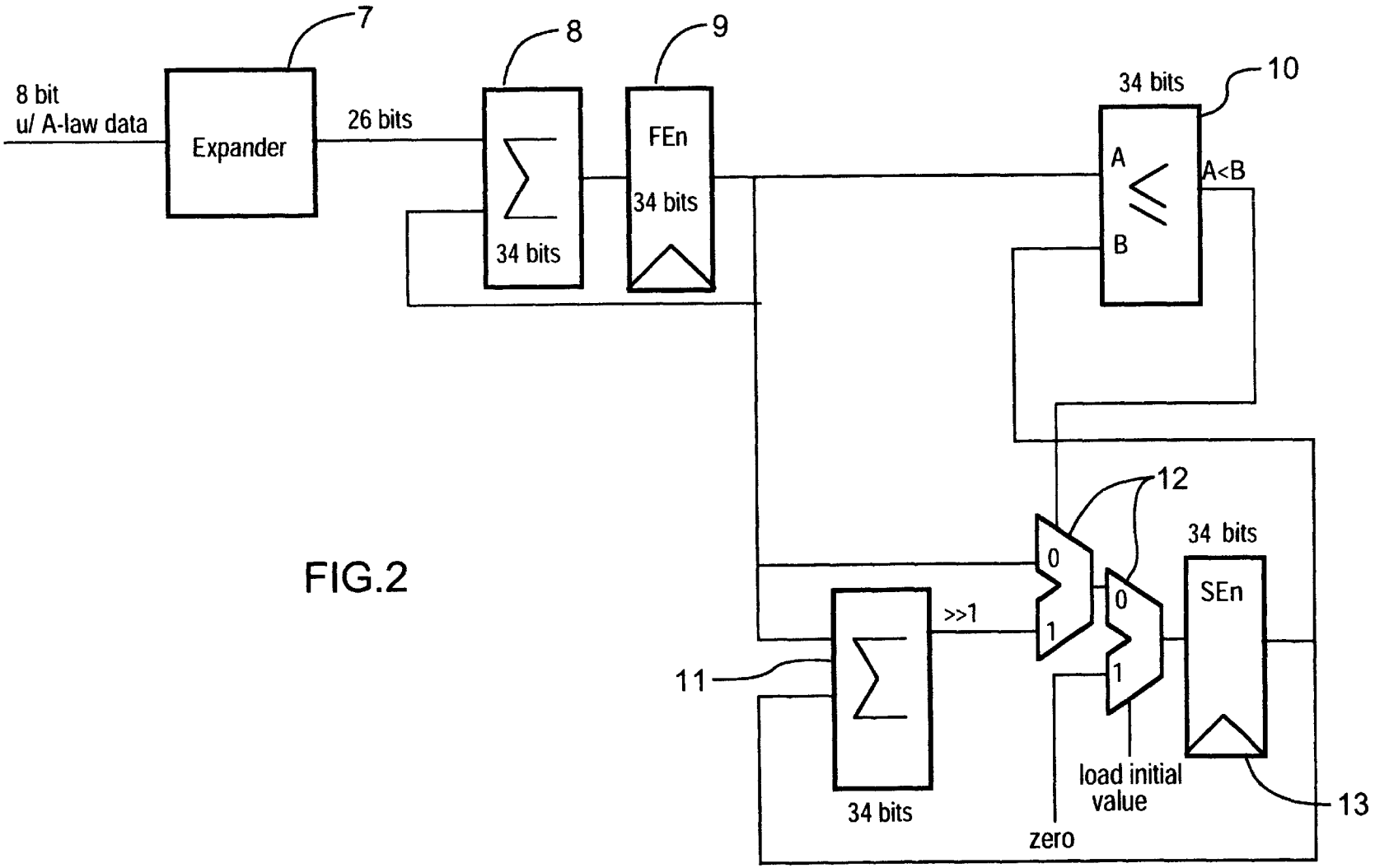
FIG. 2 is a block diagram of a smoothed packet energy calculator forming part of the silence detector according to the preferred embodiment.

The smoothed packet energy calculator (14) is shown in greater detail with reference to FIG. 2. Voice data samples, which are companded according to 8-bit u-Law or A-Law, in accordance with ITU-T specification G.711, are first passed through an expander (7) on entering the silence detector (5). The expander is a combinatorial circuit which produces the square of the magnitude of the linear value of the sample. This value is 26 bits wide and represents the energy of the sample. The energy of all of the samples in the packet is summed as they are read into the FIFO (3), by means of an accumulator formed from an adder (8) and register (9). The accumulated energy values of up to 256 samples in a packet can be accommodated by making the accumulator 34 bits wide. At the end of the accumulation operation, the value in register (9), $FE_n$, represents the total energy of the packet.

A "smoothed" energy value is developed from $FE_n$ according to the following algorithm:

$$\text{If } (FE_n > SE_{(n-1)}) \text{ then } SE_n = FE_n$$

$$\text{else } SE_n = 0.5 * SE_{(n-1)} + 0.5 * FE_n$$

This causes the smoothed energy to respond instantly to increases in packet energy and to decay gradually, in order to avoid clipping the start and end of a speech burst. The smoothing operation is implemented by a comparator (10), adder (11) multiplexors (12) and register (13) which contains the smoothed energy value $SE_n$.

For the condition of $SE_n >= FE_n$, the 0.5 multiplication factor is implemented by shifting the value output from the accumulators (12) by one bit to the right as it is loaded into the register (13). The smoothed energy accumulator is initialised with a "zero" value via the second one of the accumulators (12). The smoothed energy value is updated with each packet, whether the packet contains speech or not.

Returning to FIG. 3, the smoothed energy value, $SE_n$, is fed to a block (15) that provides a noise level signal, NL (16), that adapts to the channel's noise level. The value of NL is adjusted only when silence is detected for a packet. This requires a SILENCE signal (21) to be fed back from silent packet detector (17). If the packet is indicated as a silent packet, then NL is adjusted, either increased or decreased, in the direction of the smoothed energy. The algorithm is represented by the following pseudo-code wherein $SE_n$ and NL are 34 bits wide and the NL_increment is smaller than $SE_n$ (e.g. 1% of $SE_n$), but is programmable for allowing a simple accumulator implementation:

Initialise NL=0

```
forever (when packet loaded into FIFO)
  if (SILENT)
    if (SEn>NL)NL=NL+NL_increment
    if (SEn<NL)NL=NL−NL_increment
  endif
endforever
```

Silent packet detector (17) uses the noise level threshold, NL, to determine if a current packet is part of a silence period or non-silence period. In particular, the detector (17) determines that a packet contains silence if $SE_n$ drops below the noise level NL multiplied by a sensitivity scaling factor (18), which is programmable (e.g. a typical value would be 1.1). Under extremely good noise conditions, silence detection according to the above implementation may occasionally fail. Accordingly, a silence floor, SF (19) parameter is introduced such that if $SE_n$ drops below SF, silence is assumed. Furthermore, a discrete tone of sufficient duration, such as may occur during in-band signalling, may be detected as silence by the smoothing and adaptive noise level threshold mechanisms. To overcome this, a silence ceiling, SC (20), is introduced having a value set to be the minimum signal level of a discrete tone. If the smoothed energy is above the ceiling SC, then non-silence is assumed. The silent packet detector (17) outputs a signal indicating a silent packet (21) according to the following algorithm:

If $(((SE_n<NL$ *Sensitivity) & $(SEn<SC))|(SEn<SF))$ then silence_detected

Each packet is thus flagged as being either a silent packet, or a non-silent packet. Silence duration monitor (22) determines whether a packet should be transmitted or not. Any packet that is flagged as non-silent is immediately transmitted. The first packet in a sequence that is marked as silent increments an internal counter, which is incremented for every successive, consecutive silent packet. Packets are transmitted until the counter reaches a predetermined value, defined by the hangover value (23). When the counter attains the hangover value, then the transmission of all subsequent, consecutive silent packets is inhibited by transmission of the INHIBIT-TRANSMIT signal to the network transmitter (4). The purpose of the hangover counter is to allow passage of fricatives and therefore the value of the hangover threshold must be longer than a fricative. The first packet that is not silent resets the hangover counter and is transmitted.

Alternative embodiments and variations of the invention are possible. For example, the expander (7) may be implemented with a look-up table. Also, the system according to the present invention works satisfactorily on absolute signal and energy levels, thus the expander need not produce an output as the square of the magnitude but simply as the magnitude, in which case the expander output will be only 13 bits wide, resulting in significant circuit savings throughout the device due to narrower data paths.

The Noise Level, NL, can be adjusted by a multiplier rather than using an increment, as set forth above, thereby resulting in a more linear result at the expense of a slight cost increase in the hardware required.

The parameters used in generating the smoothed energy value, $SE_n$, can be other than 0.5. For example, $SE_n=0.75*SE_{(n-1)}+0.25*FE_n$ or other scaling factors may be used, depending on the application.

A fricative detector is provided to enhance detection of fricatives at the beginning and end of talk spurts. The fricative detector may be designed to reside in the smoothed energy calculator (14) for feeding an additional fricative signal to the silent packet detector (17). The fricative detector operates on the basis that fricatives are higher in frequency than noise. Therefore, a fricative signal has a higher zero-crossing rate than noise. Thus, the fricative detector according to this alternative embodiment can be implemented in the expander (7). When the 8-bit companded data is expanded, a sign bit is generated. Detecting a change in the sign bit indicates a zero-crossing. The number of changes are summed over the packet and compared with a zero-crossing threshold which is pre-programmed in a register and is related to the packet size and frequency of fricatives. The fricative signal is fed to the silent packet detector (17) and incorporated in the pseudo-code algorithm set forth above, as:

If (~FRICATIVE & $(((SEn<NL$ *Sensitivity) & $(SEn<SC))|(SEn<SF)))$ then silence_detected All such modifications and alternative embodiments may be made without departing from the sphere and scope of the invention as defined by the claims appended hereto.

What is claimed is:

1. A method of detecting silence in a packetized voice communication system, comprising the steps of:

calculating a total energy value $FE_n$ for each packet of voice and calculating therefrom a smoothed energy value $SE_n$ as follows:

$$\text{if}(FE_n>SE_{(n-1)}) \text{ then } SE_n=FE_n,$$

$$\text{else } SE_n=A*SE_{(n-1)}+B*FE_n,$$

wherein A and B are predetermined multiplication factors;

calculating a noise value for said voice communication system during periods of said silence;

detecting one of either presence or absence of fricatives in said packet of voice;

establishing a silence ceiling value and a silence floor value; and comparing said smoothed energy value to said noise value and said silence ceiling and silence floor values and in the event of an absence of fricatives and said smoothed energy value is intermediate said silence ceiling and silence floor values and is less than said noise value then indicating detection of said silence.

2. The method of claim 1, wherein A=B=0.5.

3. The method of claim 1, wherein A=0.75 and B=0.25.

4. The method of claim 1, wherein said step of calculating said noise value comprises the further steps of calculating a nosie level NL as follows:

$$\text{if } (SE_n>NL)NL=NL+NL_\text{increment}$$

$$\text{if } (SE_n<NL)NL=NL-NL_\text{increment}$$

wherein NL_increment is a predetermined value smaller than either $SE_n$ or LN, and multiplying said noise level NL by a predetermined sensitivity scaling factor.

5. The method of claim 1, further comprising the step of counting a predetermined number of consecutive packets containing silence before indicating said detection of silence, thereby permitting fricatives to be transmitted.

6. A silence detector for inhibiting transmission of silence packets by a network transmitter, comprising:

a packet energy calculator for calculating an energy value $SE_n$ for each packet of voice data to be transmitted, wherein said packet energy calculator further comprises an expander for generating sample energy values, an accumulator for summing said sample energy values for each packet thereby resulting in a total packet energy value $FE_n$ and circuitry for receiving said total packet energy value $FE_n$ and in response generating a smoothed energy value $SE_n$, as follows:

$$\text{if}(FE_n > SE_{(n-1)}) \text{ then } SE_n = FE_n$$

$$\text{else } SE_n = A * SE_{(n-1)} + B * FE_n,$$

wherein A and B are predetermined multiplication factors;

a noise level detector for receiving a silence_detected signal and in response calculating a noise value NL for said voice data during periods of silence;

a silence packet detector for receiving a silence ceiling value SC, a silence floor value SF, a sensitivity value, said energy value $SE_n$ and said noise value NL, and in response generating said silence_detected signal in the event that $SE_n$<SF or $SE_n$<NL*Sensitivity and $SE_n$<SC; and a fricative detector for counting zero crossings of said sample energy values output from said expander, comparing said zero crossings to a predetermined zero crossing threshold value and in the event said number of zero crossings exceed said zero crossing threshold value then inhibiting generation of said silence_detected signal.

7. The silence detector of claim 6, further comprising a silence duration monitor for counting a predetermined number of consecutive packets containing silence and thereafter generating a signal for inhibiting said transmitter.

8. The silence detector of claim 6, wherein A=B=0.5.

9. The silence detector of claim 6, wherein A=0.75 and B=0.25.

10. The silence detector of claim 6, wherein said noise level detector generates said noise level as follows:

$$\text{if}(SE_n > NL) NL = NL + NL_increment$$

$$\text{if}(SE_n < NL) NL = NL - NL_\text{increment},$$

wherein NL-increment is a predetermined value smaller than either $SE_n$ or NL.

* * * * *